US006003260A

United States Patent [19]

Chang

[11] Patent Number: 6,003,260

[45] Date of Patent: Dec. 21, 1999

[54] PHOTOGRAPH FRAME ASSEMBLY WITH A ROTATABLE SUPPORTING MEMBER

[75] Inventor: Tung-Ming Chang, Taichung Hsien, Taiwan

[73] Assignee: Fanthing Electrical Corp., Taichung Hsien, Taiwan

[21] Appl. No.: 09/211,219

[22] Filed: Dec. 14, 1998

[51] Int. Cl.[6] ..... G09F 1/12

[52] U.S. Cl. ..... 40/748; 40/747; 248/472; 248/688

[58] Field of Search ..... 40/748, 747, 754; 248/469, 472, 688

[56] References Cited

U.S. PATENT DOCUMENTS 5,329,712 7/1994 Keller ..... 40/747

*Primary Examiner*—Cassandra H. Davis

*Attorney, Agent, or Firm*—Ladas & Parry

[57] ABSTRACT

A photograph frame assembly includes a rectangular photograph frame, a rectangular back plate secured to the photograph frame, and a supporting member which is retained on the back plate by a retainer. The retainer extends through the back plate to couple with the supporting member, thereby retaining the supporting member on the back plate in such a manner that the supporting member can rotate freely on the back plate. The supporting member supports the back plate in an inclined position, and can be folded on the back plate. Preferably, the supporting member includes a plate body having a horizontal bottom side and a coupling upper end portion, a unitary plastic fixed element fixed on the coupling upper end portion, and a unitary plastic movable element mounted movably on the fixed element. The movable element is coupled with the retainer, and is rotatable synchronously with the retainer on the back plate. The plate body can be folded on the back plate by moving the fixed element relative to the movable element.

4 Claims, 8 Drawing Sheets

PHOTOGRAPH FRAME ASSEMBLY WITH A ROTATABLE SUPPORTING MEMBER

BACKGROUND OF THE INVENTION

This invention relates to a photograph frame assembly with a supporting member for supporting a photograph frame in an inclined position, more particularly to a rectangular photograph frame assembly which has a rotatable supporting member that can be adjusted so as to contact a selected one of the four sides of a rectangular photograph frame with a support, such as a desk top, when supporting the photograph frame.

2. Field of the Related Art

Referring to FIG. 1, a conventional photograph frame assembly is shown to include a rectangular photograph frame 10, a back plate 11, a hinge unit 12, and a supporting member 13. The supporting member 13 is mounted rotatably on a rear side surface of the back plate 11 by means of the hinge unit 12, and has a V-shaped lower end portion, which includes an inclined first side 131 and an inclined second side 132. The photograph frame 10 and the back plate 11 can be supported by the supporting member 23 in a first position shown in FIG. 1, where a short side 112 of the back plate 11 is aligned with the inclined first side 131 of the supporting member 13, or a second position shown in FIG. 2, where a long side 113 of the back plate 11 is aligned with the inclined second side 132 of the supporting member 13. When the aforesaid conventional photograph frame assembly is supported on a desk, only two choices can be made with respect to the relative positions between the supporting member 13 and the back plate 11, thereby failing to satisfy the needs of the user.

SUMMARY OF THE INVENTION

The object of this invention is to provide a photograph frame assembly with a rotatable supporting member, which can be adjusted so as to contact a selected one of the four sides of a rectangular photograph frame with a support, such as a desk top, when supporting the photograph frame in an inclined position.

According to this invention, a photograph frame assembly includes a rectangular photograph frame, a rectangular back plate secured to the photograph frame, and a supporting member which is retained on the back plate by means of a retainer. The retainer extends through the back plate to couple with the supporting member, thereby retaining the supporting member on the back plate in such a manner that the supporting member can rotate freely on the back plate. The supporting member supports the back plate in an inclined position, and can be folded on the back plate. Preferably, the supporting member includes a plate body having a horizontal bottom side and a coupling upper end portion, a unitary plastic fixed element fixed on the coupling upper end portion, and a unitary plastic movable element mounted movably on the fixed element. The movable element is coupled with the retainer, and is capable of rotating synchronously with the retainer on the back plate. The plate body can be folded on the back plate by moving the fixed element relative to the movable element.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
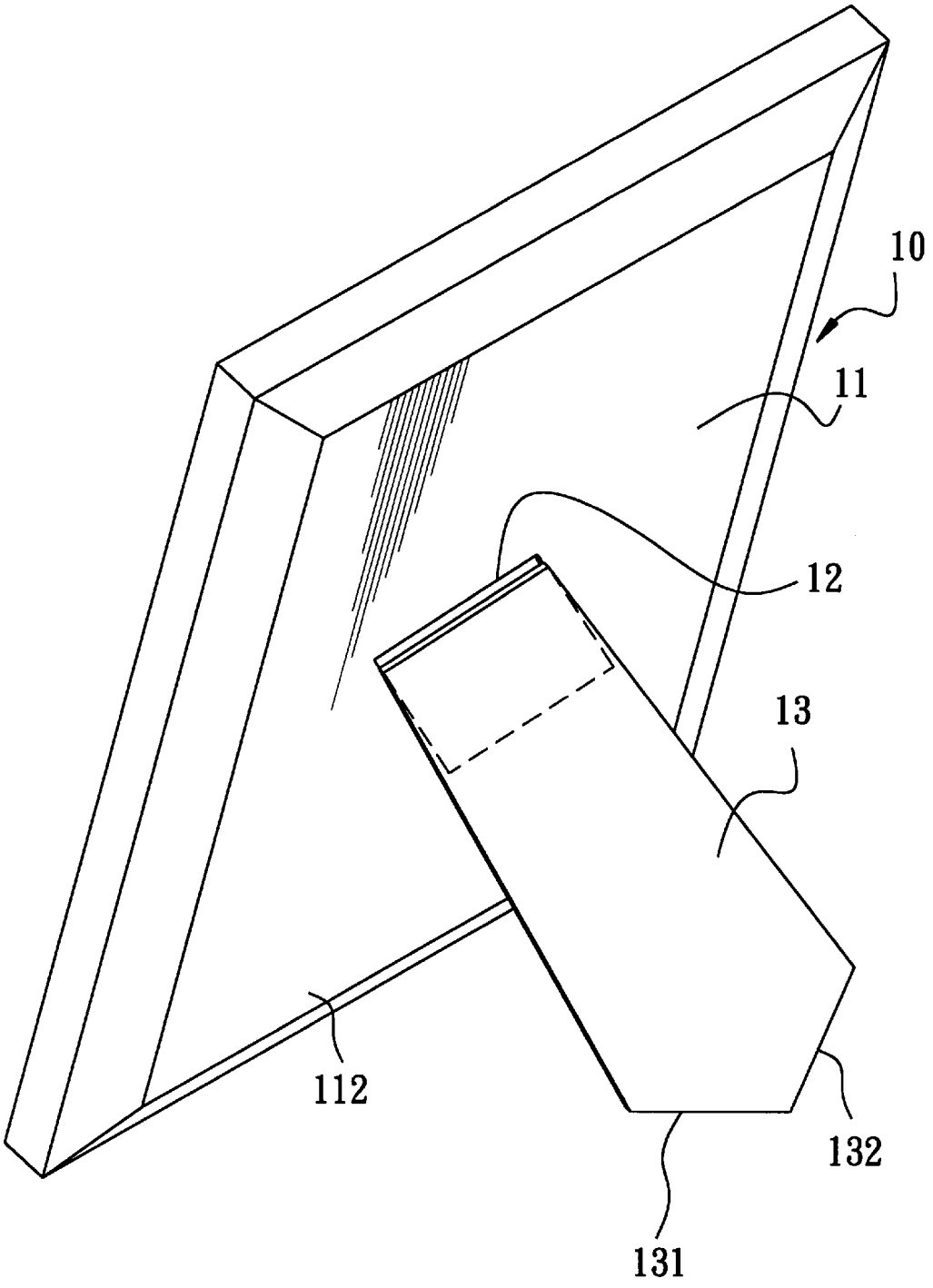
FIG. 1 PRIOR ART
FIGS. 1 and 2 illustrate two relative positions of a supporting member and a back plate of a conventional photograph frame assembly.
Figure 2:
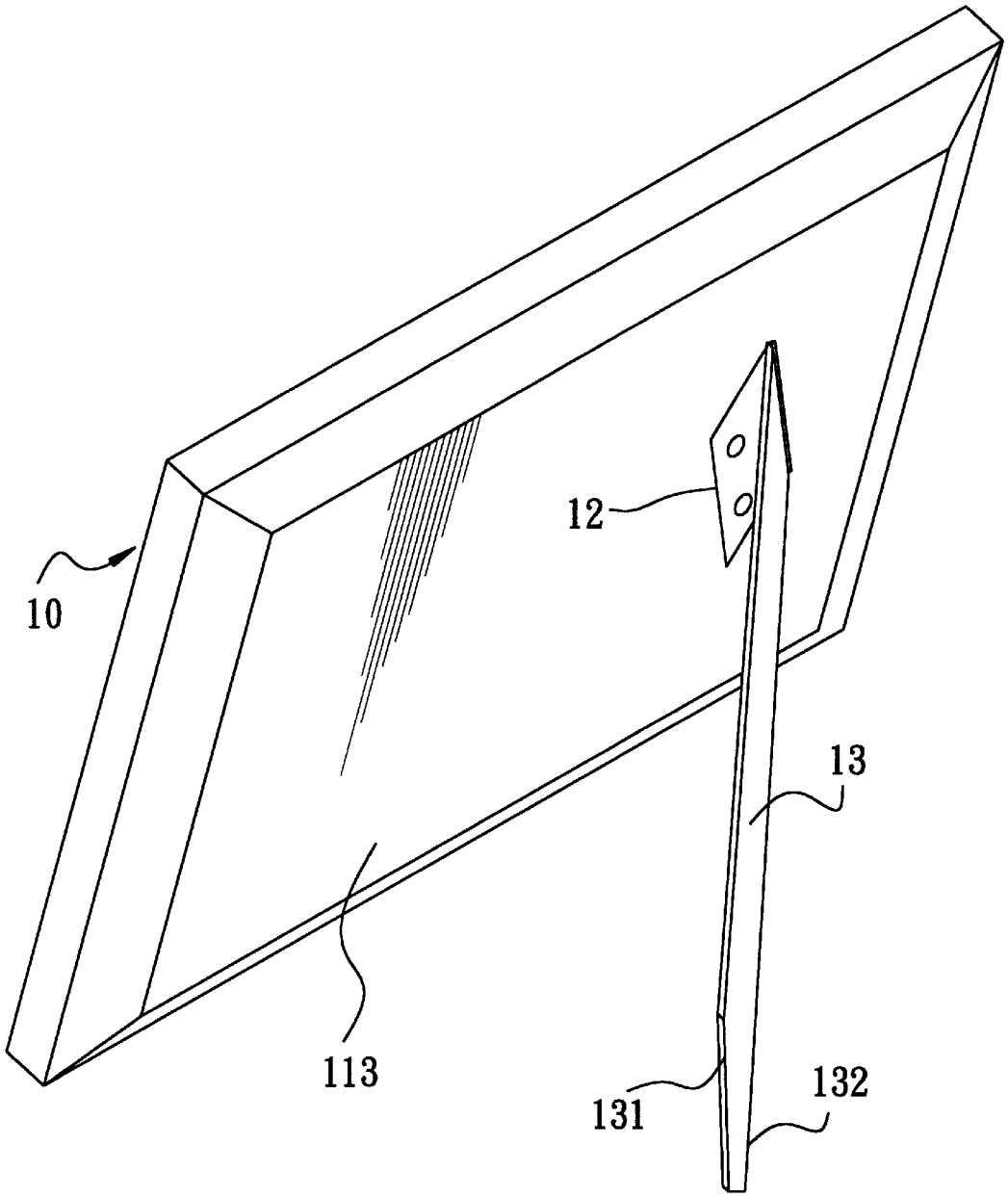
FIG. 2 PRIOR ART
Figure 3:
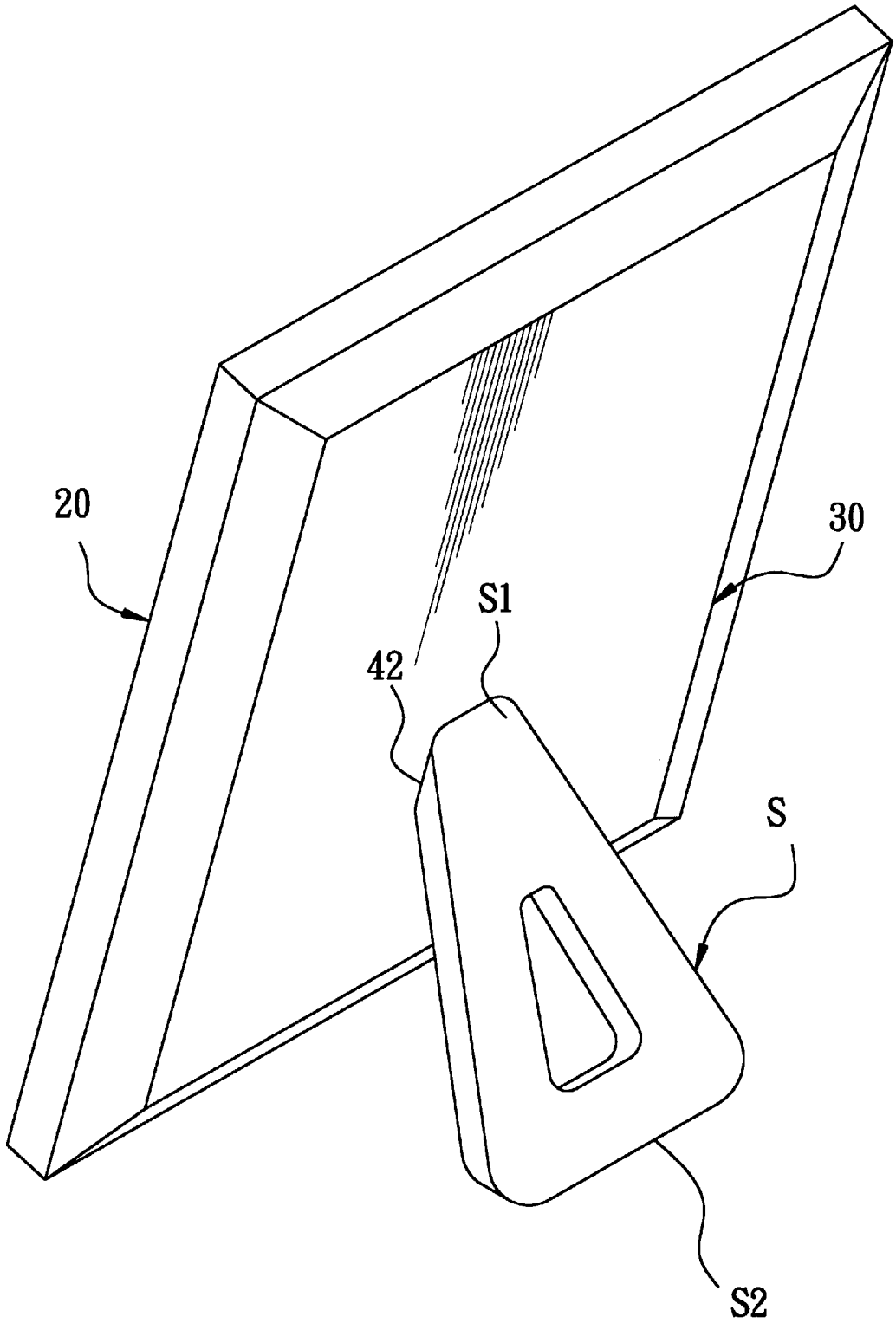
FIG. 3 is an assembled perspective view of the preferred embodiment of a photograph frame assembly according to this invention.
Figure 4:
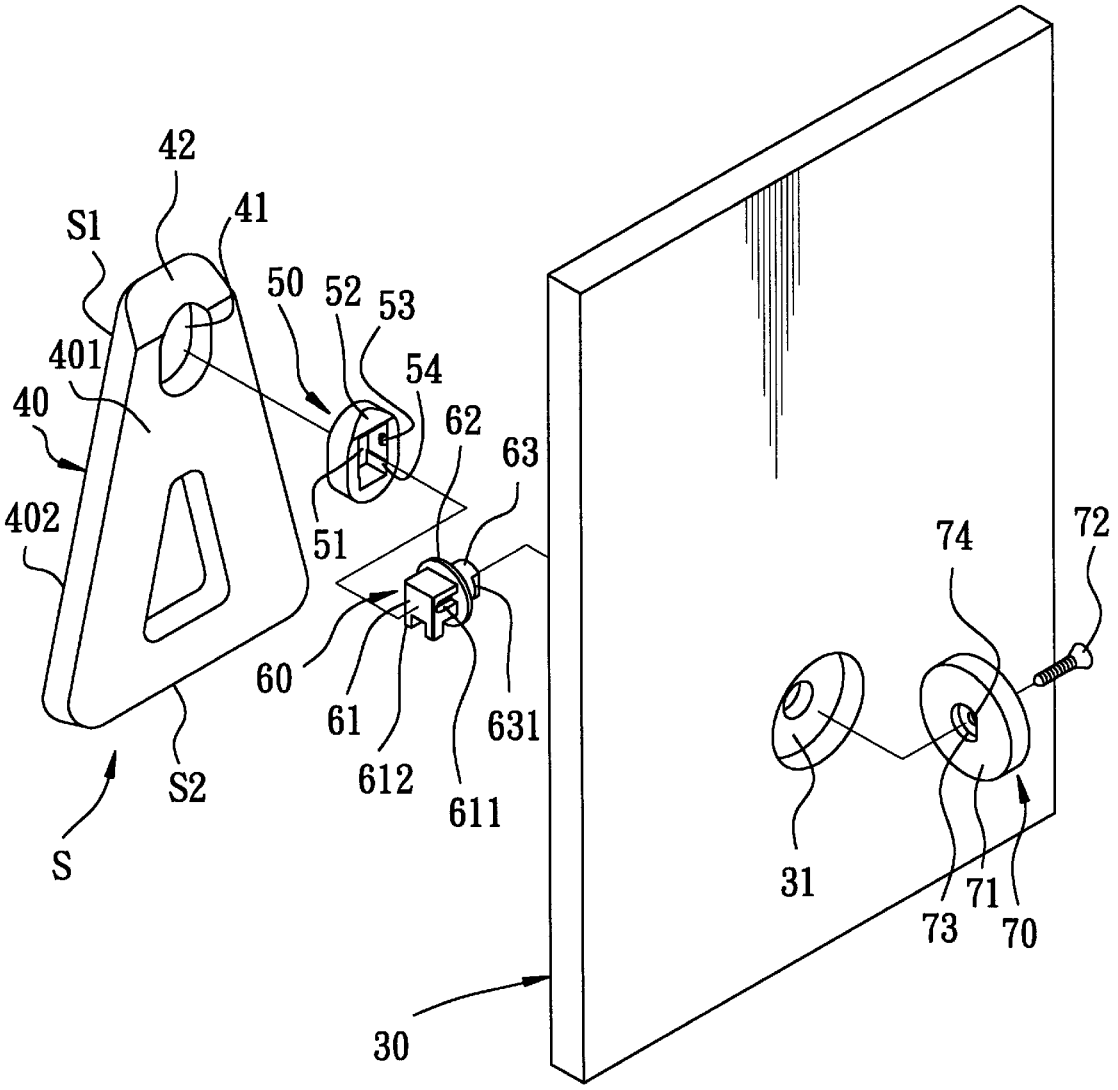
FIG. 4 is an exploded perspective view of the preferred embodiment.
Figure 5:
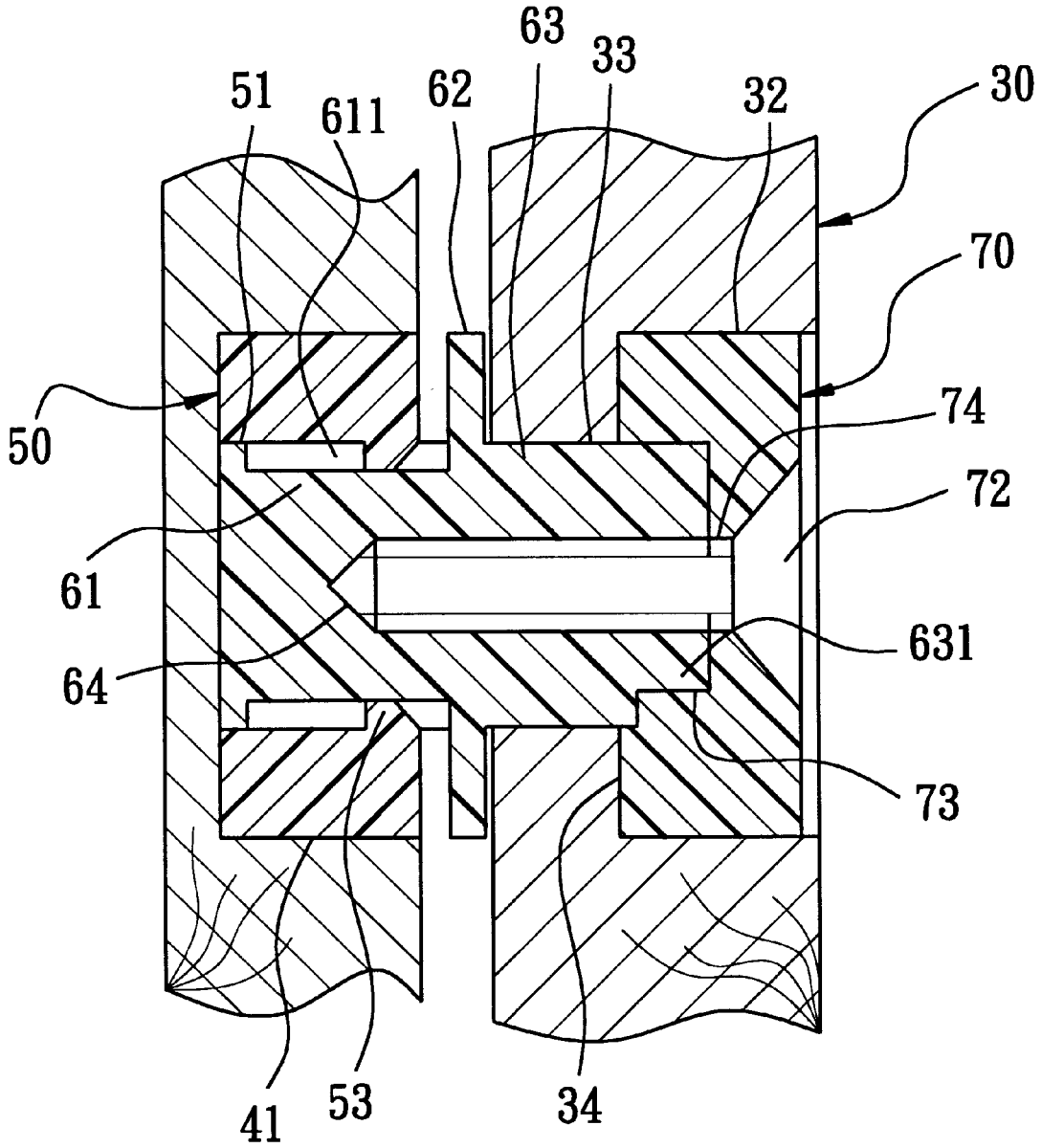
FIG. 5 is a schematic sectional top view illustrating the interconnection between a supporting member and a retainer of the preferred embodiment.

Referring to FIGS. 3, 4 and 5, the preferred embodiment of a photograph frame assembly according to this invention is shown. The assembly includes a rectangular photograph frame 20, a rectangular backplate 30, and a supporting member (S), which consists of a plate body or triangular plate 40, an annular fixed element 50, and a movable element 60. The supporting member (S) is retained on the back plate 30 by means of a retainer 70. The fixed element 50 and the movable element 60 are unitary, and are made of plastic.

The back plate 30 has a counterbore 31 (see FIG. 4), which is formed therethrough and which consists of a large-diameter section 32 (see FIG. 5) and a small-diameter section 33 (see FIG. 5) that are located respectively in front and rear side surfaces of the back plate 30. The large-diameter and small-diameter sections 32, 33 of the counterbore 31 define a shoulder 34 (see FIG. 5) therebetween.

The supporting member (S) has a coupling upper end portion (S1) and a horizontal bottom side (S2), and supports the back plate 30 in an inclined position, as shown in FIG. 3.

Figure 6:
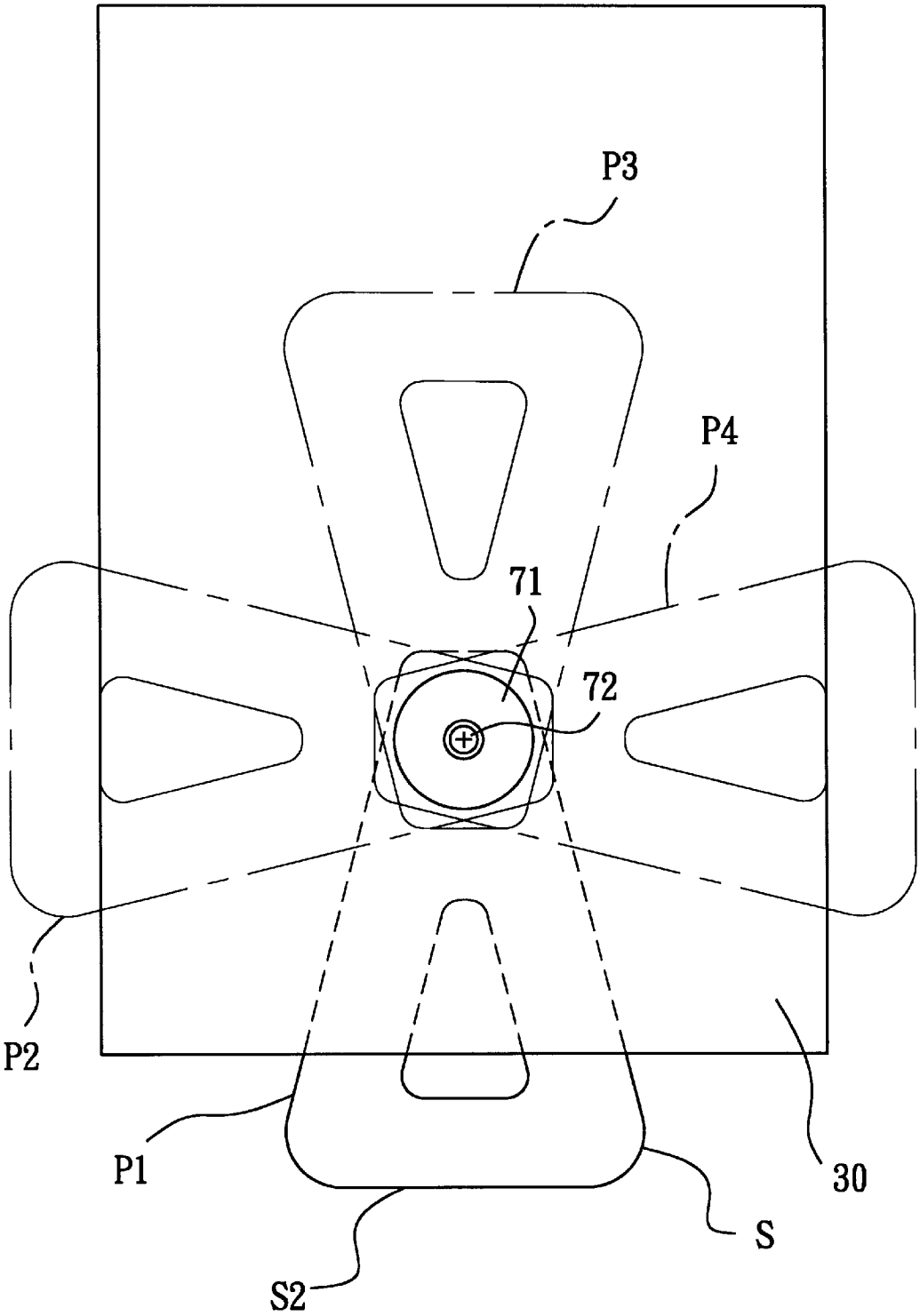
FIG. 6 is a schematic view illustrating four supporting positions of the supporting member relative to a back plate of the preferred embodiment.

The retainer 70 includes a ring body 71 and a screw 72. The ring body 71 is received fittingly and rotatably within the large-diameter section 32 of the counterbore 31 in the back plate 30, and has a rear side surface which is formed with a semicircular groove 73, and a front side surface, which is formed with a fastener hole 74 that is communicated with the semicircular groove 73. The screw 72 extends through the hole 74, the groove 73 and the counterbore 31 to couple with the coupling upper end (S1) of the supporting member (S), and is capable of rotating within the counterbore 31 in the back plate 30 to locate the supporting member (S) at a selected one of four supporting positions (P1), (P2), (P3), (P4) (see FIG. 6). Each adjacent pair of the supporting positions (P1), (P2), (P3), (P4) (see FIG. 6) are angularly spaced apart from each other by 90°. In this way, the horizontal bottom sides (S2) of the supporting member (S) can be aligned with a selected one of the four sides of the back plate 30, which contacts a support, such as a desk top, when the photograph frame 20 is supported in an inclined position.

The triangular plate 40 has a flat front side surface 401, a flat rear side surface 402, an accommodating hole 41 formed through an upper end portion of the plate 40, and an inclined abutment surface 42. The abutment surface 42 is at an angle to the flat front and rear side surfaces 401, 402, and abuts against the rear side surface of the back plate 30.

The fixed element 50 is adhered into the accommodating hole 41 in the triangular plate 40, and includes a central hole 51 formed therethrough, and an inclined abutment surface 52 which abuts against the rear side surface of the back plate 30 and which is flush with the abutment surface 42 of the triangular plate 40. In the central hole 51, two opposed horizontal upper projections 53 and two opposed horizontal lower projections 54 are formed on the fixed element 50. The lower projections 54 are located under the upper projections 53, respectively.

The movable element 60 includes a rear section 61, a middle disk 62, and a front section 63.

The rear section 61 extends slidably into the central hole 51 in the fixed element 50, and has two vertical side surfaces, each of which has a retaining slot 611. The retaining slots 611 in the rear section 61 of the movable element 60 and the upper projections 53 of the fixed element 50 constitute a retaining device, which retains the supporting member (S) on the back plate 30. The retaining slots 611 receive respectively and slidably the upper projections 53 of the fixed element 50 therein to retain the movable element 60 on the fixed element 50. Sliding movement of the upper projections 53 in the slots 611 permits the supporting member (S) to be folded on the back plate 30. Two spaced-apart legs 612 protrude integrally and downwardly from two opposite sides of a rear end portion of the rear section 61. The lower projections 54 of the fixed elements 50 and the legs 612 of the movable element 60 constitute a positioning device, which positions the supporting member (S) relative to the back plate 30.

The disk 62 is formed integrally with the rear section 61.

Figure 7A:
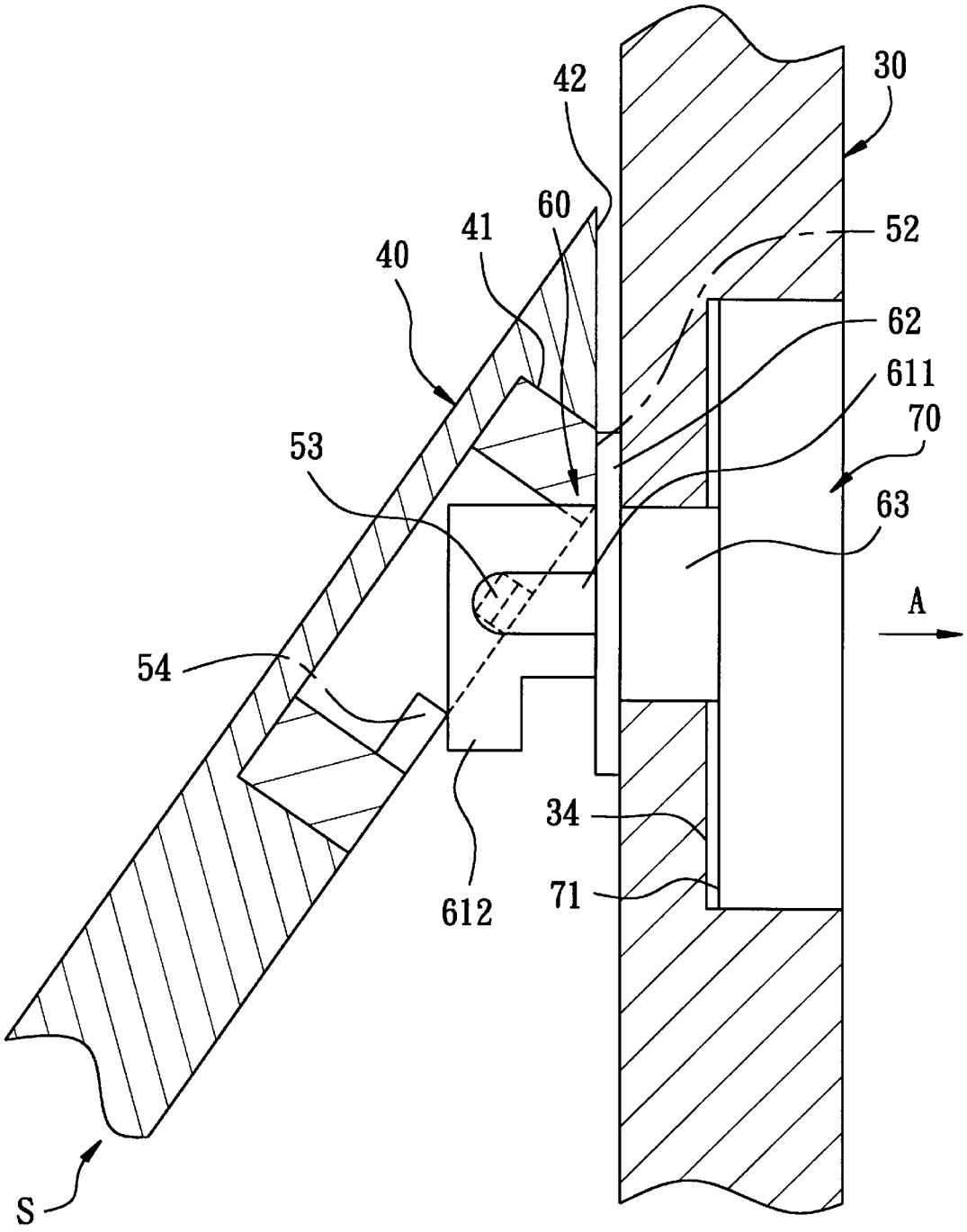
FIGS. 7*a* and 7*b* illustrates how the supporting member is folded on the back plate of the preferred embodiment.

The front section 63 has a rear end which is formed integrally with the disk 62, a semicircular-cross-sectioned front end portion 631, and a front end surface which is formed with a threaded hole 64 (see FIG. 5). The front end portion 631 extends through the counterbore 31 in the back plate 30 to engage fittingly the semicircular groove 73 in the ring body 71. The ring body 71 is spaced apart from the disk 62 of the movable element 60 at a distance which is slightly longer than the length of the small-diameter section 33 of the counterbore 31 in the back plate 30, thus providing a clearance between disk 62 and backplate 30. As shown in FIG. 7*a*, when the photograph frame 20 is supported in an inclined position by the supporting member (S), abutment surface 42 contacts disk 62 of the movable element 60, forcing disk front section 63 and ring body 71 in the direction indicated by arrow "A", absorbing the clearance between disk 62 and backplate 30 until the periphery of disk 62 abuts against backplate 30. The ring body 71 is then spaced apart from the shoulder 34 of the back plate 30. Accordingly, the movable element 60 can rotate synchronously with the retainer 70 on the back plate 30.

Figure 7B:
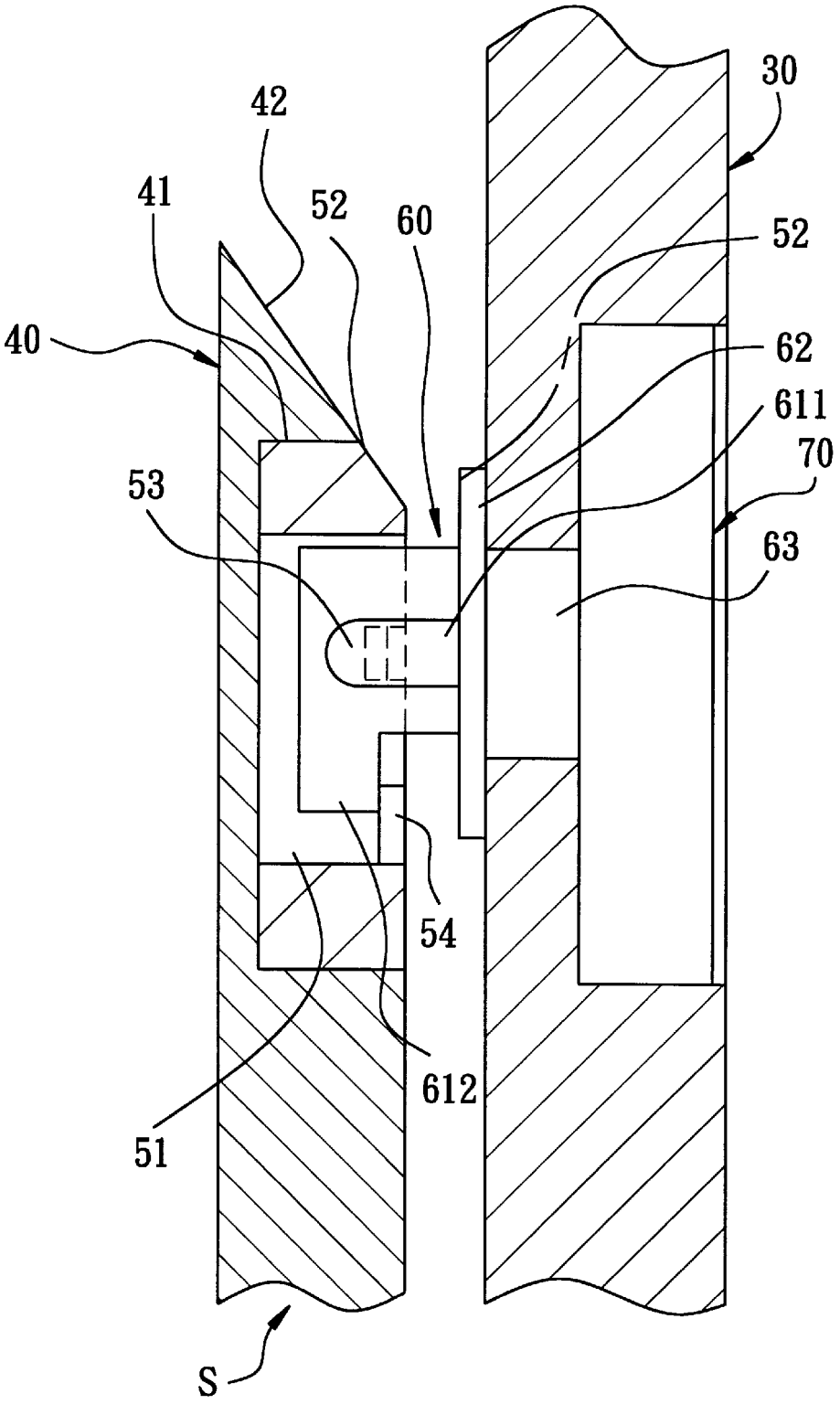

The supporting member (S) can be turned from a supporting position shown in FIG. 7*a*, where the back plate 30 is supported in an inclined position, to a folded position shown in FIG. 7*b*.

To position the supporting member (S) on the back plate 30, the lower projections 54 of the fixed element 50 are movable relative to the back plate 30 between a first position shown in FIG. 7*a*, where the lower projections 54 abut respectively against the rear faces of the legs 612 of the movable element 60 to locate the supporting member (S) at the supporting position, and a second position shown in FIG. 7*b*, where the lower projections 54 abut respectively against the front faces of the legs 612 of the movable element 60 to locate the supporting member (S) at the folded position.

Since the fixed element 50 and the movable element 60 are made of plastic, the upper projections 53 of the fixed element 50 can be easily inserted into the retaining slots 611 in the movable element 60 to couple the fixed element 50 and the movable element 60 together. In addition, the lower projections 54 of the fixed element 50 can be moved between the first position behind the legs 612 of the movable elements 60, and the second position in front of the legs 612 of the movable elements 60, With this invention thus explained, it is apparent that numerous modifications and variations can be made without departing from the spirit and scope of this invention. It is therefore intended that this invention be limited only as indicated in the appended claims.

I claim:

1. A photograph frame assembly comprising:

a rectangular photograph frame;

a rectangular back plate fixed on said photograph frame;

a supporting member having a coupling upper end portion and a horizontal bottom side and located at a supporting position relative to said back plate to support said back plate in an inclined position, said supporting member being movable to a folded position in which said supporting member is folded on said back plate; and a retainer extending through said back plate to couple with said coupling upper end portion of said supporting member to retain said supporting member on said back plate, said retainer being rotatable on said back plate to align a selected one of four sides of said back plate with said horizontal bottom side of said supporting member;

wherein said supporting member includes:

a plate body having said horizontal bottom side;

a unitary plastic fixed element which is fixed on said plate body;

a unitary plastic movable element coupled with said retainer to rotate synchronously with said retainer on said back plate;

a retaining device for retaining said movable element on said fixed element while permitting sliding movement of said movable element on said fixed element; and a positioning device for positioning said movable element on said fixed element even when said supporting member is folded on said back plate.

2. A photograph frame assembly as claimed in claim 1, wherein:

said movable element of said supporting member has a generally semicircular-cross-sectioned front end portion, and a front end surface, which is formed with a threaded hole;

said back plate having a rear side surface and a front side surface which is formed with a counterbore, said counterbore being formed through said back plate and having a large-diameter section and a small-diameter section, between which a shoulder is defined; and said retainer including a ring body and a screw, said ring body having a rear side surface which is formed with a generally semicircular groove that engages fittingly said generally semicircular-cross-sectioned front end portion of said movable element, and a front side surface which is formed with a fastener hole that is communicated with said semicircular groove, said screw extending through said fastener hole, said generallly semicircular groove in said ring body and said counterbore in said back plate to engage said threaded hole in said movable element, said rear side surface of said ring body being spaced apart from said shoulder of said back plate, thereby permitting rotation of said retainer and said movable element relative to said back plate.

3. A photograph frame assembly as claimed in claim 2, wherein said plate body is a triangular plate, and has said horizontal bottom side, a flat front side surface, a flat rear side surface parallel to said flat front side surface, an inclined abutment surface which is at an angle to said flat front and rear side surfaces and which abuts against said rear side surface of said back plate, and an accommodating hole formed in an upper end portion of said triangular plate; and said fixed element is adhered into said accommodating hole in said triangular plate.

4. A photograph frame assembly as claimed in claim 2, wherein:

said fixed element includes a central hole formed therethrough, two opposed horizontal upper projections formed in two opposite sides of said central hole, and two opposed horizontal lower projections formed in two opposite sides of said central hole under said upper projections; and said movable element includes:

a rear section extending slidably into said central hole in said fixed element and having two vertical side surfaces;

two retaining slots which are formed respectively in said side surfaces of said rear section to receive respectively and slidably said upper projections of said fixed element therein, said upper projections of said fixed element sliding in said retaining slots in said movable element when said supporting member is folded on said back plate, said retaining slots in said front section of said movable element and said upper projections of said fixed element constituting said retaining device;

two spaced-apart legs protruding integrally and downwardly from two opposite sides of a rear end portion of said front section, each of said legs having a front face and a rear face which is opposite to said front face, said legs of said movable element and said lower projections of said fixed element constituting said positioning device;

a middle disk formed integrally with a front end of said rear section and abutting against said rear side surface of said back plate at a periphery of said disk; and a front section formed integrally with said disk at a rear end thereof and having a front end surface in which said threaded hole is formed, said screw extending through said fastener hole and said semicircular hole in said retainer to engage said threaded hole in said front section, thereby retaining said front section on said back plate;

said lower projections of said fixed element being movable relative to said back plate between a first position, where said lower projections abut respectively against said rear faces of said legs of said movable element to locate said supporting member at said supporting position, and a second position, where said lower projections abut respectively against said front faces of said legs of said movable element to locate said supporting member at said folded position.

* * * * *